US008902069B2

(12) United States Patent
Martinez et al.

(10) Patent No.: US 8,902,069 B2
(45) Date of Patent: Dec. 2, 2014

(54) SNOOZE ALERT

(75) Inventors: Edmund M. Martinez, Las Vegas, NV (US); Darrell T. Harness, Las Vegas, NV (US); Edmund P. Martinez, Las Vegas, NV (US)

(73) Assignee: Edmund M. Martinez, Las Vegas, NV (US)

( * ) Notice: Subject to any disclaimer, the term of this patent is extended or adjusted under 35 U.S.C. 154(b) by 158 days.

(21) Appl. No.: 13/507,531

(22) Filed: Jul. 6, 2012

(65) Prior Publication Data

US 2014/0009294 A1 Jan. 9, 2014

(51) Int. Cl.
*G08B 23/00* (2006.01)

(52) U.S. Cl.
USPC ..... 340/575; 340/573.1; 340/407.1; 340/384.1

(58) Field of Classification Search
CPC ..... G08B 21/06; G08B 3/00; G08B 6/00; G08B 7/00; G08B 21/02; G08B 21/0446
USPC ..... 340/575
See application file for complete search history.

(56) References Cited

U.S. PATENT DOCUMENTS

| | | | | |
|---|---|---|---|---|
| 2,747,038 | A * | 5/1956 | Perkovich | 200/52 R |
| 5,488,354 | A * | 1/1996 | Bobby | 340/576 |
| 5,568,127 | A * | 10/1996 | Bang | 340/575 |
| 2009/0121882 | A1 * | 5/2009 | Al-Mutairi | 340/575 |

* cited by examiner

*Primary Examiner* — Kerri McNally

(57) ABSTRACT

The Snooze Alert is a device that prevents a person from falling asleep while driving a vehicle, truck, bus or for any reason that requires a person to stay awake and alert. The advantage of this device is that it does not hang on the ear and it has three sources of power. The Snooze Alert is incased in a soft pouch with an adjustable strap that holds the pouch between the lower chin and the upper chest area. When a person's head tilts forward or to the side, like when falling asleep the chin depresses the activator switch which send an electrical current that activates the vibrator and the buzzer and thereby instantly waking up the person.

3 Claims, 7 Drawing Sheets

26G.
2- Screws
26A.
Upper
Plate
26H.
6- Nuts
26B.
Insulation
Plate
26C.
copper
Plate
26I.
2-Springs
26D.
copper
Plate
26E.
Insulation
Plate
26F.
Bottom
Plate Top View
32
30
28
36
36A
ON
OFF
22
20
24
26
Side View
26
22
30
32
20
32A
34
28

26
26
30
30
ON
OFF
22
22
24
20
28
34
20
34
32
32A

Top View of The Base-20

Bottom View of The Base - 20

SNOOZE ALERT

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

STATEMENT REGARDING PRIOR DISCLOSURES BY THE INVENTOR OR A JOINT INVENTOR

Not Applicable

BACKGROUND OF THE INVENTION

Not Applicable

BRIEF SUMMARY OF THE INVENTION

The Snooze Alert is a device with only one purpose: to keep a person awake and alert when driving a car, bus, truck or an airline flight controller or whoever is required to stay awake and alert. The Snooze Alert is incased in a pouch that is placed between the lower chin and the upper chest area with an adjustable straps to hold the device in place.

The difference from other alerts is that it does not hang on the ear and it has three different sources of power; two rechargeable AA batteries, incased in the battery container (22), an attachment for a vehicle twelve volt system and a 110 volt adaptor (24), when used with the 110 volt reducer, which also will charge the batteries. All the elements are attached to the base (20), with an oblong cutaway at the lower section of the base. The battery container is glued to the top section of the base and is equipped with an on and off switch. The activator (26) which is the automatic switch is glued to the top lid of the container. The vibrator (30) fits loosely on the cutaway section, held in place by two upper straps (32) and two bottom straps (32A) with Velcro at the ends to secure the vibrator. The buzzer (28) is attached to the bottom of the base. The foam rubber cushion (34) is glued to the bottom of the base to cushion the upper chest area. When the Snooze Alert is in position and the head tilts forward of the side, like when falling asleep, the chin depresses the activator which instantly delivers an electrical current to the buzzer and the vibrator simultaneously creating a loud noise and rattling the sensitive chest area and instantly awakening the person. When the head returns to the normal position, the activator stops the electrical current to the buzzer and vibrator.

BRIEF DESCRIPTION OF THE SEVERAL VIEWS OF THE DRAWING(S)

FIG. 1—A perspective view of one version of the top of the Snooze Alert;

FIG. 2—An exploded view of the Activator;

FIG. 3—The top and side view of the Snooze Alert;

FIG. 4—The side and end views of the Activator;

FIG. 5—A perspective view of the top of the base;

FIG. 6—A perspective view of the bottom of the base;

FIG. 7—A pouch and adjustable neck strap which houses the Snooze Alert.

DETAILED DESCRIPTION OF THE INVENTION

FIG. 1 shows the embodiment of the Snooze Alert, displaying a perspective view of one version of the top of the Snooze Alert. The base (20) holds all of the components. The batteries and container (22), sends an electrical current through the positive and negative wiring, (36 & 36A) to the Activator (26). When compressed, it activates the vibrator (30) and the buzzer (28), until the pressure is released from the activator. The connection for direct current (DC) is supplied by an alternating current (AC) adaptor (24). The two straps (32) hold the vibrator (30) in place. The chest cushion (36) provides comfort to the user.

FIG. 2 shows an exploded view of the Activator (26). The upper plate (26A) is an aluminum plate, followed by the insulation plate (26B), two copper plates (26C & 26 D), another insulation plate (26E) and the bottom aluminum plate (26F). The two copper plates are separated by two springs (26I).

FIG. 3 shows a top and side view of the Snooze Alert. The top view displays the base (20), the battery container (22), the AC adaptor (24), the activator (26), the vibrator (30) and the two upper straps (32). The side view shows the base (20), the battery container (22), the activator (26). The buzzer (28), the vibrator (30), the two upper straps (32), the two lower straps (32A) and the chest cushion (34).

Figure 1:
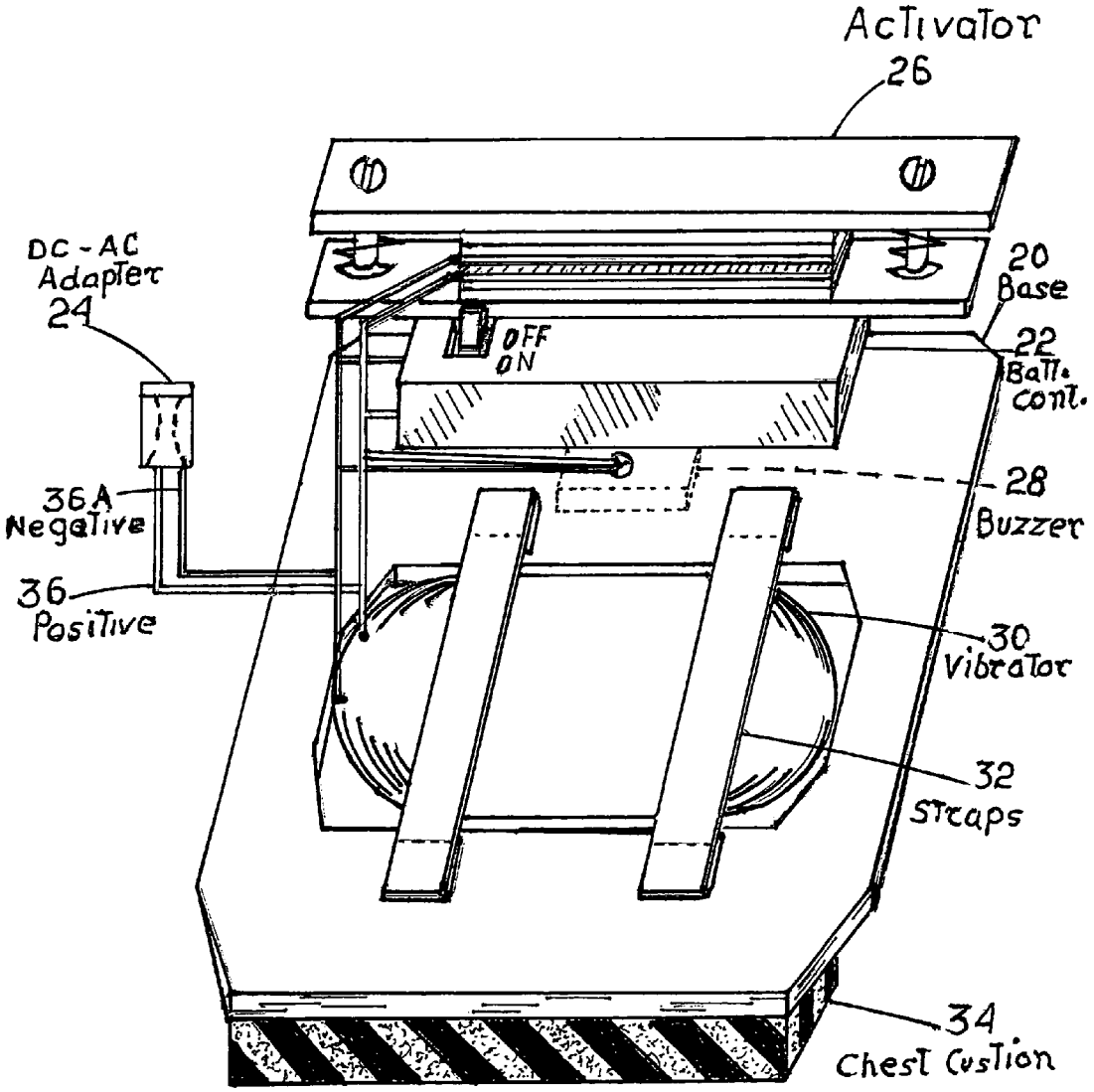
Figure 2:
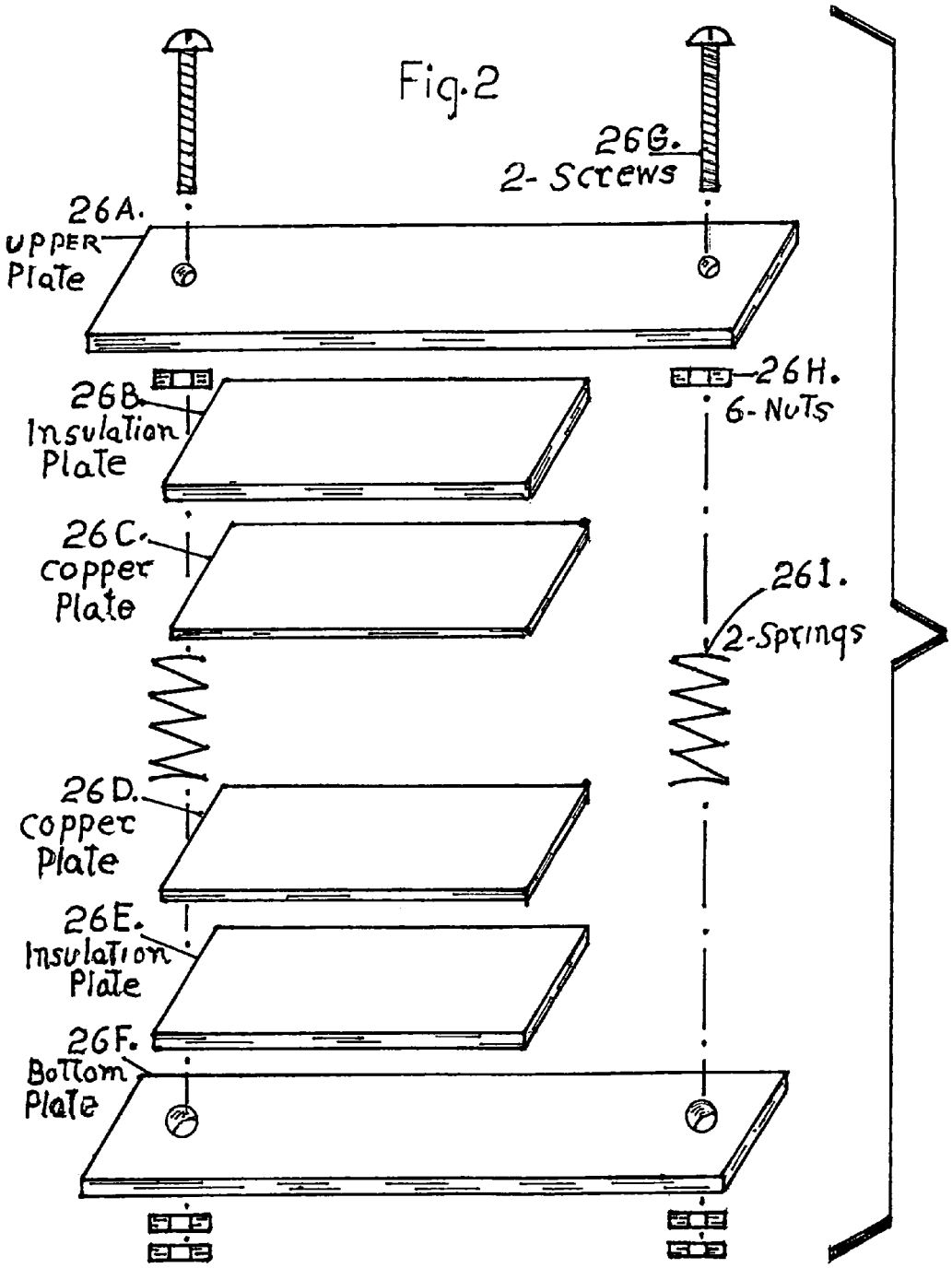
Figure 3:
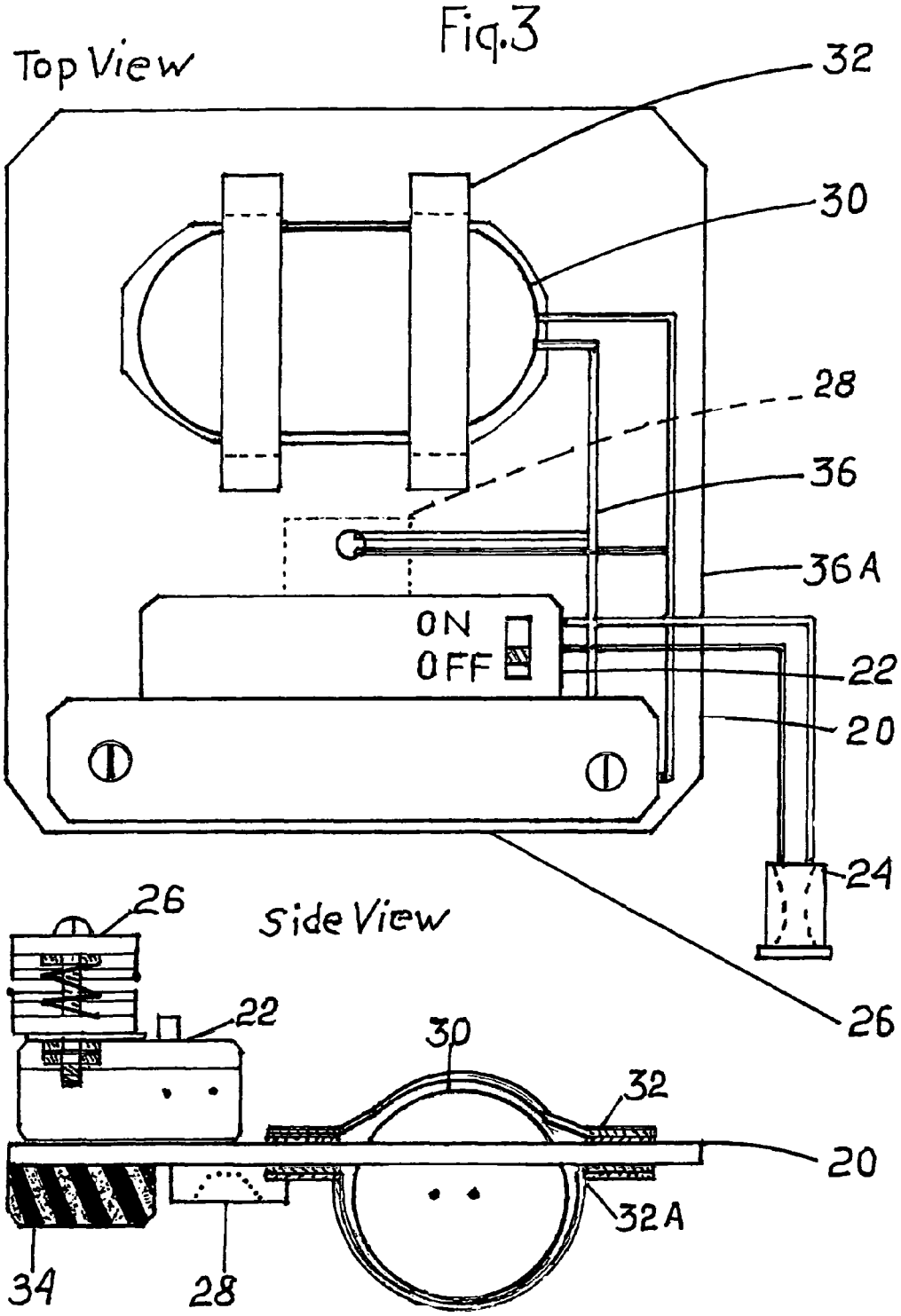
Figure 4:
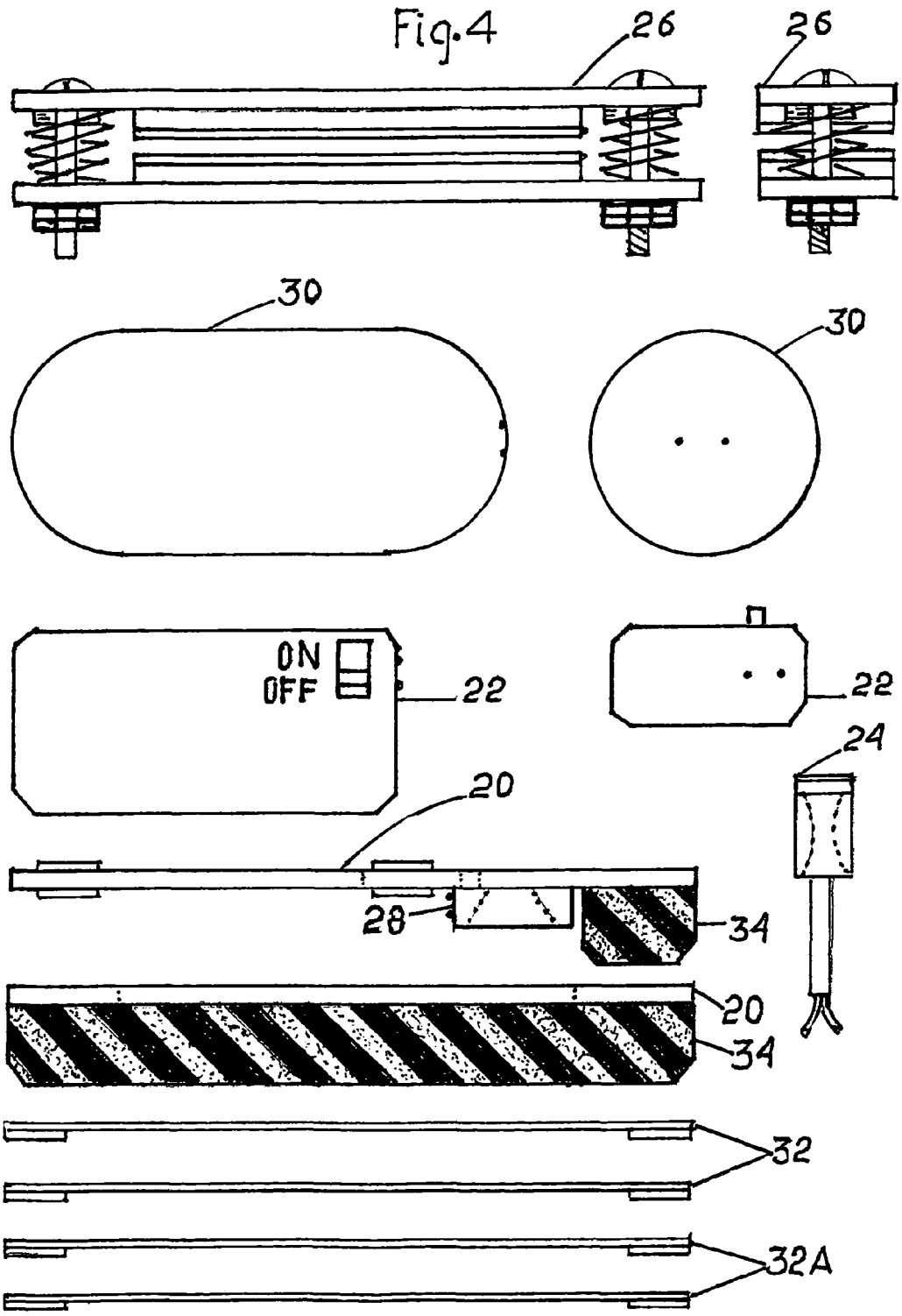
FIG. 4 shows the side and end views of the activator (26), the vibrator (30), battery container (22), the base (20), the buzzer (28), the chest cushion (34) the AC adaptor (24) and the two upper and lower straps (32 & 32A).
Figure 5:
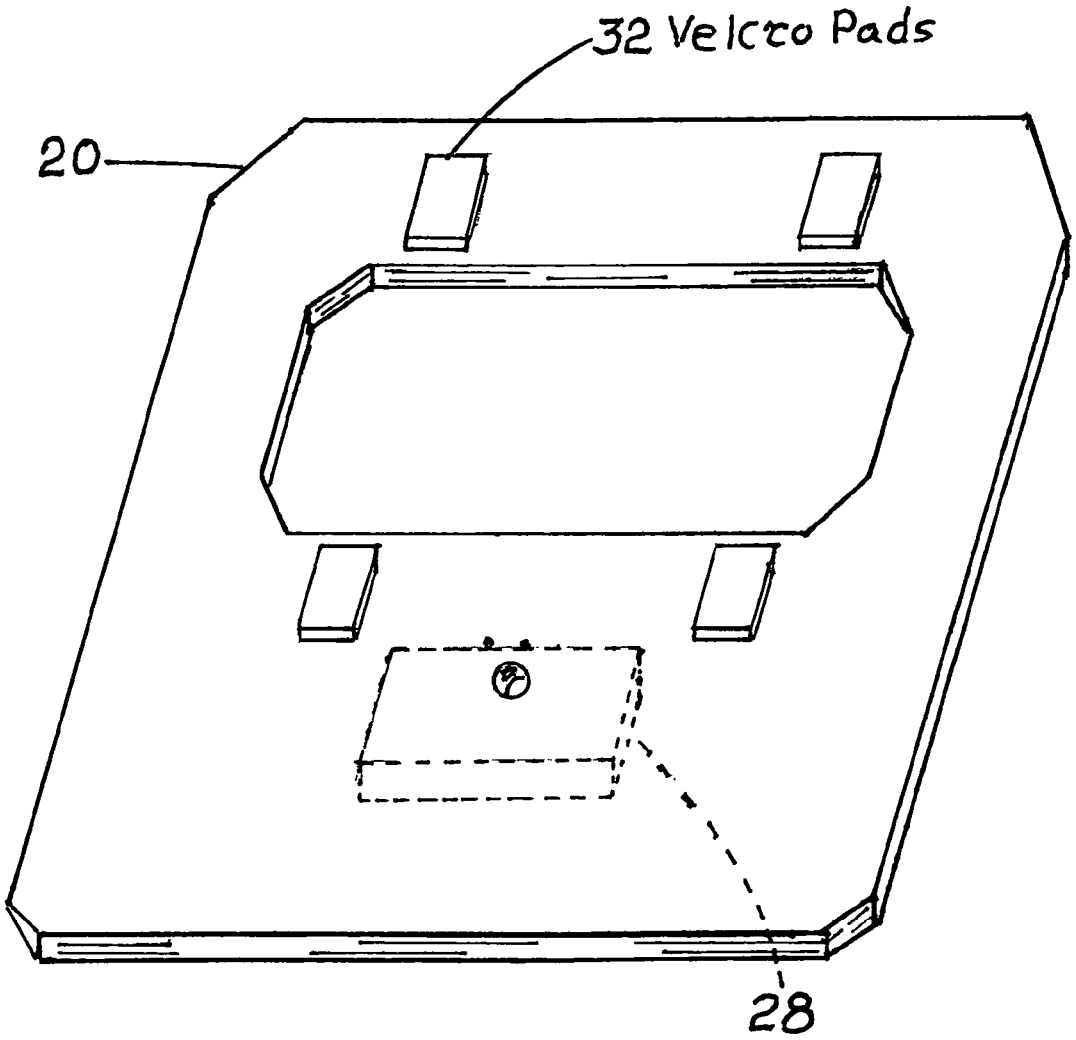
FIG. 5 shows a perspective view of the top of the base (20), four Velcro pads that the straps (32) attach to and the position of the buzzer (28).
Figure 6:
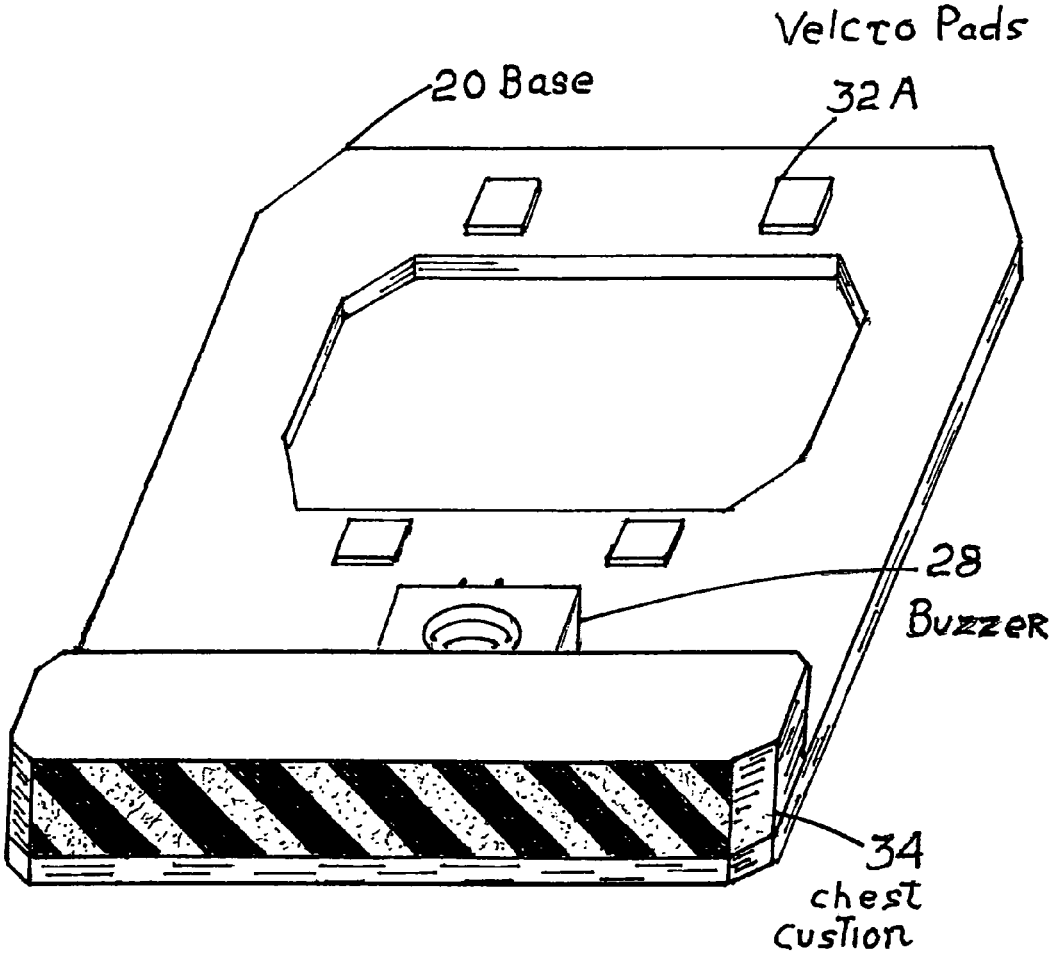
FIG. 6 shows a perspective view of the bottom of the base (20), four Velcro pads that the straps (32A) attach to, the buzzer (22) and the chest cushion (34).
Figure 7:
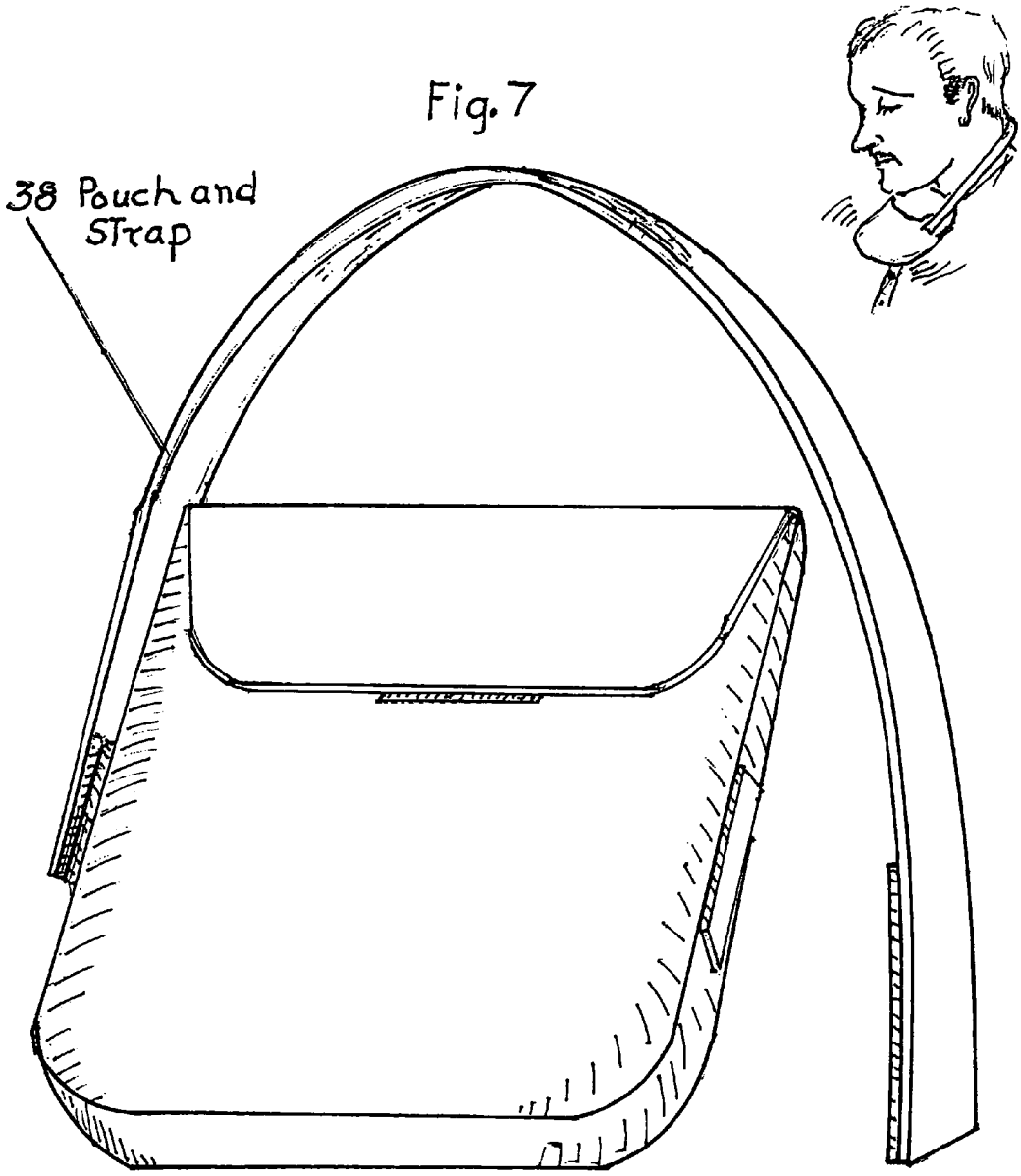
FIG. 7 shows the pouch and adjustable neck strap which houses the Snooze Alert.

The invention claimed is:

1. A snooze alert device to be placed between the lower chin and upper chest area of a person, the snooze alert device comprising:

a terry cloth pouch with an adjustable strap that encases the following elements:

a base;

a battery container glued to the top of the base;

an activator glued to a lid of the battery container;

a vibrator that fits inside a cutaway hole of the base and wherein the vibrator is held in place by two upper straps and two bottom straps;

an AC/DC jack connected to a positive terminal and a negative terminal;

a buzzer located underneath the base and connected to the positive and negative terminals; wherein when a person has the snooze alert device in place and the person's head tilts forward, the chin touches the activator and that releases an electrical current to the vibrator and simultaneously to the buzzer, which immediately awakens the person; and when the person's head returns to an upright position, the person's chin is no longer touching the activator and the current flow to the buzzer and vibrator stops.

2. The snooze alert device of claim 1, wherein the activator comprises an upper aluminum plate, a perfboard insulation plate, a copper plate, a bottom copper plate, a bottom insulation perfboard plate, a bottom aluminum plate, two machine screws, six nuts, and two coil springs; and wherein the activator is an automatic switch that controls and distributes the flow of current to the vibrator and the buzzer; and wherein the activator is located on top of the battery container at an upper section of the base.

3. The snooze alert device of claim 1, further comprises an on and off switch that send electrical power to the activator and an upper chest cushion which cushions the upper chest area.

* * * * *